US005498047A

United States Patent [19]

Treuling

[11] Patent Number: 5,498,047

[45] Date of Patent: Mar. 12, 1996

[54] TEXTILE LIFTING SLING WITH REINFORCEMENT

[75] Inventor: Walter Treuling, Geilenkirchen, Germany

[73] Assignee: Spanset Inter AG, Oetwil am See, Switzerland

[21] Appl. No.: 367,126

[22] PCT Filed: May 4, 1994

[86] PCT No.: PCT/DE94/00499

§ 371 Date: Mar. 21, 1995

§ 102(e) Date: Mar. 21, 1995

[87] PCT Pub. No.: WO94/26648

PCT Pub. Date: Nov. 24, 1994

[30] Foreign Application Priority Data

May 6, 1993 [DE] Germany ..... 9306743 U

[51] Int. Cl.[6] ..... B66C 1/18

[52] U.S. Cl. ..... 294/74

[58] Field of Search ..... 294/74; 57/210, 57/211, 235; 139/408, 409, 411, 412; 428/190, 193, 245, 257–259, 373

[56] References Cited

U.S. PATENT DOCUMENTS

| | | | |
|---|---|---|---|
| 3,290,083 | 12/1966 | Norton | 294/74 |
| 3,368,837 | 2/1968 | Norton | 294/74 |
| 3,899,206 | 8/1975 | Miura | 294/74 |
| 3,908,571 | 9/1975 | Motsenbocker . | |
| 4,200,325 | 4/1980 | Johnson | 294/74 |
| 4,209,044 | 6/1980 | Taki . | |
| 5,238,279 | 8/1993 | Anteau | 294/74 |

FOREIGN PATENT DOCUMENTS

| | | |
|---|---|---|
| 0498253 | 8/1992 | European Pat. Off. . |
| 8906334.1 | 8/1989 | Germany . |
| 9005711.2 | 12/1990 | Germany . |

*Primary Examiner*—Johnny D. Cherry
*Attorney, Agent, or Firm*—Spencer & Frank

[57] ABSTRACT

A lifting sling assembly comprising a textile lifting sling. The lifting sling defines a longitudinal direction and a webbed direction perpendicular to the longitudinal direction, and comprises a work surface region and a loop region. The lifting sling assembly includes a reinforcement disposed on at least one of the edges and the surfaces of the lifting sling for protecting the lifting sling from abrasion. The reinforcement comprises a textile overlay at least partially surrounding the lifting sling at at least one of the work surface region and the loop region thereof. The textile overlay includes a woven strip having first zones and second zones located side-by-side in the webbed direction of the lifting sling, the first zones having a higher wear resistance than the second zone, the first zones further covering at least one of the edges and the surfaces of the lifting sling, and the second zones being firmly bonded to the lifting sling.

9 Claims, 2 Drawing Sheets

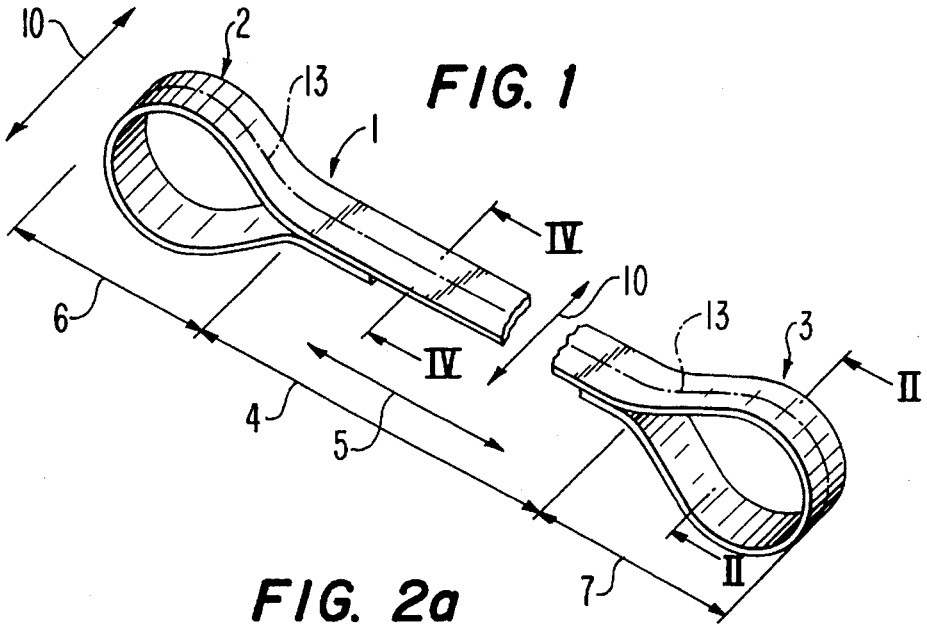
FIG. 1
FIG. 2a
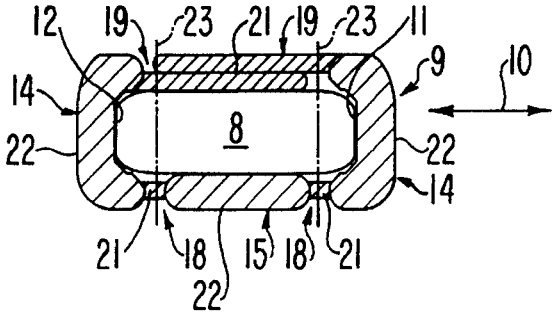
FIG. 2b
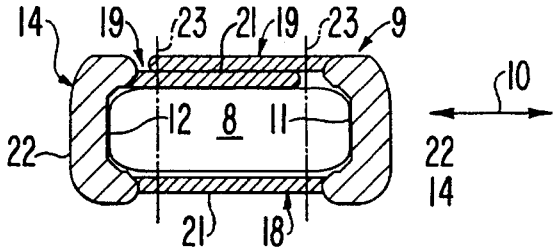
FIG. 2c
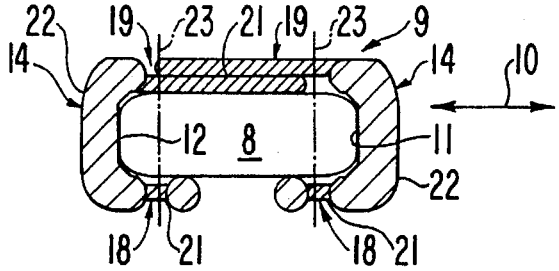

TEXTILE LIFTING SLING WITH REINFORCEMENT

BACKGROUND OF THE INVENTION

The invention relates to a lifting sling assembly comprising a textile lifting sling. The lifting sling defines a longitudinal direction and a webbed direction perpendicular to the longitudinal direction, and comprises a work surface region and a loop region. The lifting sling assembly further includes a reinforcement disposed on at least one of the edges and the surface of the lifting sling for protecting the lifting sling from abrasion. The reinforcement comprises a textile overlay at least partially surrounding the lifting sling at at least one of the work surface region and the loop region thereof.

Lifting slings of this kind are discussed in DIN (German Industrial Standard) 61360, dated March 1986, at Part 1 (concerning terms, dimensions, and impact types) and at Part 2 (concerning safety requirements and testing). By definition, reinforcements on the lifting sling comprise additional material permanently bonded to the lifting sling, for instance by stitching.

The invention relates in particular to lifting slings of the kind classified in versions 2N (concerning woven slings including a reinforcement) and 4N (concerning plaited slings including a reinforcement), and in form B (concerning slings with loops), in the systematic overview of lifting sling forms and embodiments on page 3 of DIN 61360, at Part 1. These reinforcements serve to protect against abrasion, especially in the area of the heavily strained lifting sling regions, such as the end loops.

Conventionally, a strip of textile material stitched on the lifting sling in the especially strained areas thereof is used as abrasion protection. For example, in a known manner, a reinforcing strip can be wrapped around the entire lifting sling in the region of the end loop of the lifting sling, and be stitched to the lifting sling. Particularly with relatively wide lifting slings, the stitched-on reinforcement in the area of the end loop has the further effect of reducing the effective sling width to approximately one-third the sling width in the region of the work surface. This width reduction in the end loop region is done in such a way that the lifting sling has at least one side edge wrapped (doubled) a direction around a longitudinal axis of the sling. In this wrapped state, the reinforcement is placed around the end loop region of the lifting sling and stitched thereto. As a result, the reinforcement has the further effect of permanently maintaining the width reduction in the region of the end loops of the sling.

The aforementioned standards prescribe that the same material as the webbing or other suitable material be used for the reinforcement, especially in the region of the end loops. In a conventional manner, a belt textile can be used that is bonded to the lifting sling as a textile overlay for the reinforcement.

For permanent fixation of reinforcements to the lifting sling, it is appropriate for their textile structure to be adequately stretchable in the region bonded to the lifting sling and thus to be adapted to the lifting sling expansion to be expected during use. These demands for stretchability of both the reinforcement fabric and the bonding of the lifting sling are somewhat contradictory to the function of abrasion protection, however. Good stretchability and good manipulability of the reinforcement when it is bonded to the lifting sling, and the avoidance of creasing which is harmful during use, require a limitation of the wall thickness of the reinforcing fabric as well. This kind of wall thickness limitation impairs the durability and effectiveness of the abrasion protection.

SUMMARY OF THE INVENTION

The object of the invention is to create a lifting sling of the type-discussed at the outset which has improved abrasion protection in the region of the end loop and/or of the work surface of the lifting sling. This object, and many more to become apparent as the specification progresses, is achieved by the invention, according to which a textile overlay includes a woven strip having first zones and second zones located side-by-side in the webbed direction of the lifting sling, the first zones having a higher wear resistance than the second zones, the first zones covering at least one of the edges and the surfaces of the lifting sling and the second zones being firmly bonded to the lifting sling.

The effect of the subject of the invention can be described briefly as follows. The textile overlay used as abrasion protection, in its region where it is bonded to the lifting sling, has the advantageous stretchability or flexibility described above and thus has an embodiment that promotes the bonding process. Between the bonding regions, the textile overlay is embodied in such a way that it can better perform the task of abrasion protection. The requisite heterogeneous structure of the textile overlay for the purpose of abrasion protection is simple to produce, by configuring the overlay as a woven strip with warp threads extending the longitudinal direction of the lifting sling. As a result, the zones located in regions corresponding to different widths of the belt and having different wear resistance can be configured simply by an appropriate selection and arrangement of the warp threads of the woven strip. For instance, in zones of increased wear resistance, a greater belt thickness can be chosen, by using thicker warp threads or a greater number of warp threads than in zones of lesser wear resistance, namely in the bonding regions. These configurations can be accomplished simply within the limits set in the aforementioned standard for material selection (DIN 61360, March 1986, Part 2, 2.1, "Werkstoffe" [Materials]).

According to one embodiment of the invention, the textile overlay can be bonded to the lifting sling by being stitched thereto. The stitching can be accomplished in a technically simple way and assures a long service life of the bond between the textile overlay and the lifting sling.

According to another embodiment of the invention, the bonding seams are configured to extend substantially in the longitudinal direction of the lifting sling. This configuration allows the stretching properties of the textile overlay to remain unaffected.

The textile reinforcement, in its bonding or seamed regions, can be provided with textile grooves extending in the warp direction. The zones of the reinforcement configured as textile grooves effect a protection of the bond between the textile overlay and the lifting sling against damage and destruction. For instance, when the lifting sling surface is mechanically strained because of frictional forces, the bonding seams cannot be destroyed.

The zones of the reinforcement located outside the textile grooves and having increased abrasion resistance are positioned in such a way, in the finished lifting sling, that they either form edge protection or surface protection for the stressed surfaces, both in the region of the work surface and in the region of the ring of the end loops thereof.

BRIEF DESCRIPTION OF THE DRAWINGS

The subject of the invention will be described in further detail in terms of exemplary embodiments shown in the drawings.

FIG. 1 is a perspective view of a woven lifting sling according to the invention.

FIGS. 2*a*–2*c* are different cross-sectional shapes of the reinforced lifting sling in the loop region along section line II—II of FIG. 1.

DETAILED DESCRIPTION OF THE INVENTION

Figure 3:
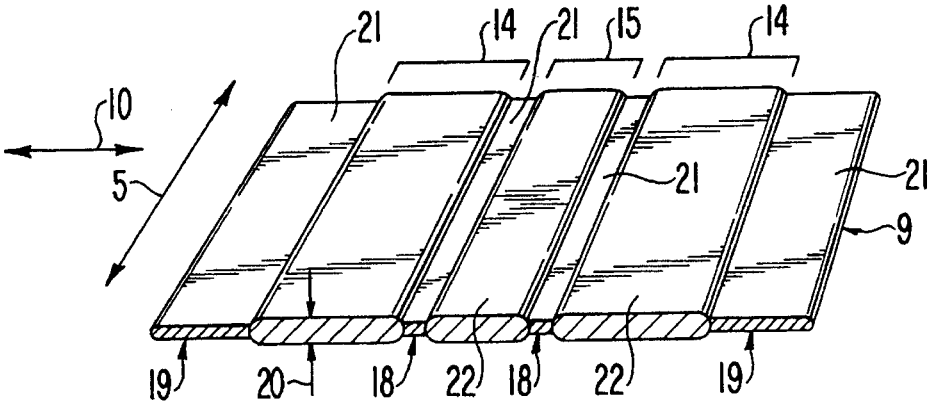
FIG. 3 is a partial cross-sectional view of the woven strip used for the overlay of FIG. 2*a*.

The lifting sling 1 shown in FIG. 1 essentially includes a work surface region 4, located between two end loops 2 and 3. The two ends of the work surface region 4 are adjoined in the longitudinal direction 5 of the belt with end loop regions 6 and 7, respectively.

If the lifting sling 1 comprises a woven webbing as the load-bearing part, then the longitudinal direction 5 of the belt represents the warp thread direction. If, however, the lifting sling is a plaited webbing—not shown in the drawings—then the longitudinal direction 5 of the belt represents the longitudinal direction of the yarn plaiting.

Figure 4:
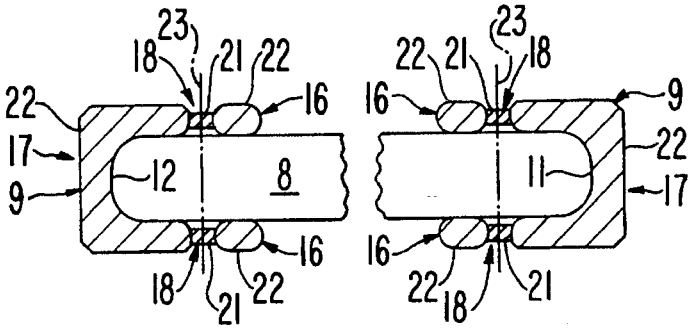
FIG. 4 is a cross section through the lifting sling in the work surface region along section line IV—IV of FIG. 1.
Figure 5:
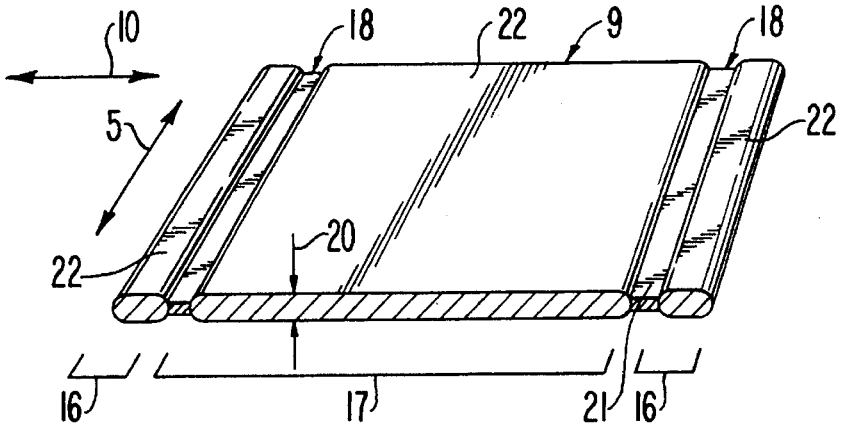
FIG. 5 is a partial cross-sectional view of the woven strip used as a textile overlay in the edge region of FIG. 4.

In the drawings, the woven webbing that forms the load-bearing part of the lifting sling 1 is identified by reference numeral 8. The webbing 8 is covered at least partially in the work surface region 4 and/or the end loop regions 6 and 7 by a textile reinforcement 9 serving as a means for abrasion protection. The non-load-bearing reinforcement 9 can completely surround the webbing 8 in the widthwise direction 10 of the belt, as shown in FIGS. 2*a* and 2*b*. However, the reinforcement 9 may also be embodied such that it only partially surrounds the webbing 8, especially in the region of its edges 11 and 12, as shown in FIGS. 2*c* and 4.

In that case, there will as a rule be two reinforcements 9 in each applicable longitudinal region of the lifting sling 1.

In the drawings, the cross section of webbing 8 is not shown in detail. This illustration therefore applies in principle not only to the embodiment of the lifting sling in the region of the end loops 6 and 7, but also in the work surface region 4, where as a general rule, there is a greater effective webbing width than in the end loop regions 6 and 7. As previously mentioned, in the end loop regions 6 and 7, an effective reduction in the belt width in the widthwise direction 10 is attained by wrapping the webbing 8 with at least one of its two edges 11 and 12 in a direction around the longitudinal axis 13 of the belt in order to double (or triple) the effective webbing thickness.

The reinforcement 9 comprises a woven strip with zones 14–17 of increased wear resistance located side by side in the widthwise direction 10 of the belt. On at least one side of these zones or between these zones, there are zones 18 and 19 of reduced wear resistance.

The woven strip used as a reinforcement 9 is configured such that its warp threads, in the stitched state, extend in the longitudinal direction 5 of the belt. Correspondingly, the weft thread direction of the textile overlay corresponds to the widthwise direction 10. The zones 14–17 are of increased wear resistance and include warp threads of greater material thickness or of greater density. The warp threads, in accordance with accepted standards, comprise polyester (PES) staple fibers or polyester multifilament yarn, an aramide fiber or the like. To increase wear resistance, higher wear resistant qualities of these materials may also be used for the applicable warp thread yarn. It is advantageous if the zones of increased wear resistance 14–17 have an increased wall thickness 20 compared with the zones 18 and 19 are configured to be of reduced wear resistance. As a result, the zones of reduced wear resistance 18 and 19, especially in the stitched state, take the form of a woven groove, whose surfaces 21 are indented compared with the surfaces 22 of the zones 14–17 of increased wall thickness 20. This indentation serves to protect the bonding seams 23 between the reinforcement 9, which serves as a protecting element, and the webbing 8, which serves as the load-bearing element. Even pronounced shear strain on surfaces 22 of zones 14–17 causes no shear strain on the bonding seams 23. Because of the seaming configuration in the region of zones 18 and 19, the stretching properties of the reinforcement 9, on its abrasion protection, remain unaffected. The positioning of the various zones 14–19 of reinforcement 9 cannot be overlooked, both in terms of the necessary relief formation of the surfaces 21 and 22, and in terms of the person working in production. Thus, the configuration of the reinforcement 9 according to the invention is to a certain extent a function of sewing instructions. Moreover, the reinforcement 9 according to the invention in the zones of lesser wear resistance 18 and 19 can more easily be bent about an axis parallel to the longitudinal axis 13 of the belt, so that manipulability in production is not impaired by the zones of increased wear resistance 14–17.

It should be noted that the reinforcement 9 according to the invention can also be employed in endless lifting slings 1 embodied in the form of a loop.

I claim:

1. A lifting sling assembly comprising:

a textile lifting sling having edges and surfaces thereon and defining a longitudinal direction and a webbed direction perpendicular to the longitudinal direction, the lifting sling further comprising a work surface region and a loop region; and a reinforcement disposed on at least one of the edges and the surfaces of the lifting sling for protecting the lifting sling from abrasion, the reinforcement comprising a textile overlay at least partially surrounding the lifting sling at least one of the work surface region and the loop region thereof, said textile overlay including a woven strip having first zones and second zones located side-by-side in the webbed direction of the lifting sling, the first zones having a higher wear resistance than the second zones, the first zones further covering at least one of the edges and the surfaces of the lifting sling, and the second zones being firmly bonded to the lifting sling.

2. The lifting sling assembly according to claim 1, wherein the second zones include bonding seams for firmly bonding the textile overlay to the lifting sling.

3. The lifting sling assembly according to claim 2, wherein the bonding seams extend substantially in the longitudinal direction of the lifting sling.

4. The lifting sling assembly according to claim 1, wherein the first zones include first warp threads and the second zones include second warp threads, the first warp threads at least partly comprising textile material different from textile material used in the second warp threads.

5. The lifting sling assembly according to claim 4, wherein the first warp threads comprise at least one of aramide yarns and wear resistance polyester yarns.

6. The lifting sling assembly according to claim 5, wherein the first warp threads comprise PES stable fiber yarns.

7. The lifting sling assembly according to claim 1, wherein the zones of lesser wear resistance comprise woven grooves.

8. The lifting sling assembly according to claim 1, wherein the textile overlay extends in the longitudinal direction of the lifting sling.

9. The lifting sling assembly according to claim 1, wherein the textile overlay is non load bearing.

* * * * *